United States Patent [19]

Chapelain et al.

[11] Patent Number: 5,035,300

[45] Date of Patent: Jul. 30, 1991

[54] SUPPORT BEAM FOR ELEVATOR SHEAVES

[75] Inventors: Jean-Claude Chapelain, Sainte-Genevieve-des-Bois; Daniel Beaulieu, Saint-Brisson/Loire, both of France

[73] Assignee: Otis Elevator Company, Farmington, Conn.

[21] Appl. No.: 444,475

[22] Filed: Dec. 1, 1989

[30] Foreign Application Priority Data

Dec. 1, 1988 [FR] France ..... 88 15753

[51] Int. Cl.[5] ..... B66B 9/16

[52] U.S. Cl. ..... 187/1 R; 187/2; 187/20; 116/321

[58] Field of Search ..... 52/30, 632; 187/1 R, 187/2, 15, 20, 23, 96; 254/390, 409; 116/2, 327, 334, 335, 212, 307, 321, 283, DIG. 1, DIG. 34; 40/299; 248/354.1, 670

[56] References Cited

U.S. PATENT DOCUMENTS

| | | | |
|---|---|---|---|
| 699,375 | 5/1902 | Ericsson | 187/2 |
| 1,967,230 | 7/1934 | Eble et al. | 116/335 X |
| 3,124,223 | 3/1964 | Kisover | 52/632 |
| 3,196,996 | 7/1965 | De La Rambelje | 52/632 X |
| 3,247,639 | 4/1966 | De La Rambelje | 52/632 |
| 3,325,957 | 6/1967 | Demeules et al. | 52/632 |
| 3,680,711 | 8/1972 | Brucker | 52/632 X |
| 3,845,842 | 11/1974 | Johnson | 187/15 |
| 3,851,736 | 12/1974 | Westlake et al. | 187/95 |
| 4,198,421 | 4/1980 | Horton | 116/283 |
| 4,664,230 | 5/1987 | Olsen | 187/95 X |
| 4,770,044 | 9/1988 | Ferris | 116/335 X |

FOREIGN PATENT DOCUMENTS

| | | |
|---|---|---|
| 04999 | 8/1987 | PCT Int'l Appl. . |
| 1306371 | 3/1969 | United Kingdom . |

*Primary Examiner*—Robert P. Olszewski
*Assistant Examiner*—Dean A. Reichard

[57] ABSTRACT

A support beam for elevator sheaves is disclosed. The support beam includes telescopic arms which are retracted for positioning the beam in the elevator shaft and, when positioned, are extended into recesses defined by the shaft walls to mount the beam in the desired position.

8 Claims, 2 Drawing Sheets

SUPPORT BEAM FOR ELEVATOR SHEAVES

DESCRIPTION

1. Technical Field

The invention relates to a support beam for elevator sheaves and in particular, a beam which may readily be mounted in the upper structure of buildings having elevators wherein the elevator machinery is located other than above the hoistway.

2. Background of the Invention

Support beams for elevator sheaves have previously been of fixed length and must be mounted by insertion of their ends into open recesses provided at the top of the elevator shaft. Such mounting requires masonry work after mounting of the beam to secure the beam in the recesses. Such an operation may impair the beam isolation arrangement relative to the building by inadvertently securing the beam directly to the building thereby preventing isolating cushions supporting the beam ends from performing their function.

DISCLOSURE OF INVENTION

The invention aims to overcome these drawbacks with a new beam of the above-mentioned kind which includes at each of its ends a telescopic arm. The telescopic arm may slide outwardly from a retracted position facilitating insertion and handling of the beam in the elevator shaft, to an extended position in which it is adapted to be mounted by its end portions in the corresponding shaft recesses provided for receiving the end portions of the beam.

The advantage of such an arrangement is that it no longer requires open recesses to be provided in the thickness of the shaft wall on construction of the building. Consequently, masons are not required to cement around the beam once it has been positioned.

The recesses may in fact be formed by simple supports for the beam arms which are mounted in the shaft wall. Preferably, they consist of masonry recesses suitably dimensioned and positioned, formed in the shaft wall. The mounting of the beam in these recesses only requires the simple operation of opening the telescopic arms of the beam outwardly to extend into these recesses. The isolating cushions between the telescopic arms and the recesses remain fully functional without the danger of being made inoperative by being embedded in cement through subsequent masonry work, as with traditional beams.

Furthermore, the inward folding of the telescopic arms of the beam in particular facilitates raising of the beam in the shaft to its top fitting position, notwithstanding that the landing doors may have already been mounted with the sills or thresholds projecting inside the shaft.

Moreover, the maximum extension of the telescopic arms, which depends on the forces acting on and the permissible flexion of the beam structure, may be locked in a limit position indicated by a label affixed to each arm at this extension level. In this way it is possible to make sure that the permissible stress limits are not exceeded.

One embodiment of the invention is described hereafter by way of non-limiting example and with reference to the accompanying drawings.

BEST MODE FOR CARRYING OUT THE INVENTION

Figure 1:
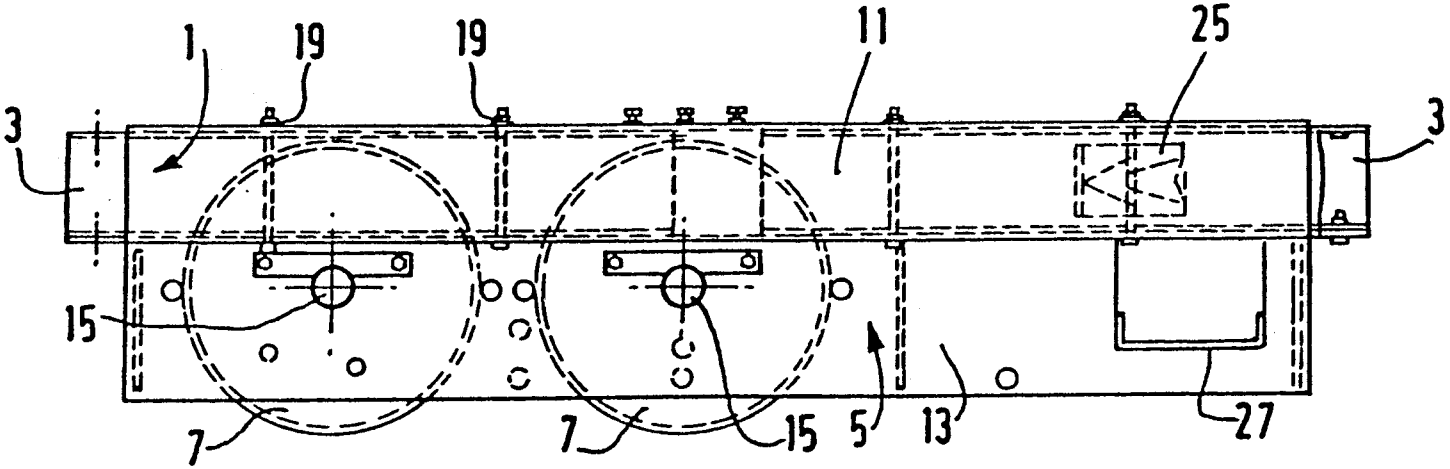
FIG. 1 is a longitudinal elevational view with parts cut away of one of the arms of a support beam in accordance with the invention, the telescopic arms being in the retracted position.
Figure 3:
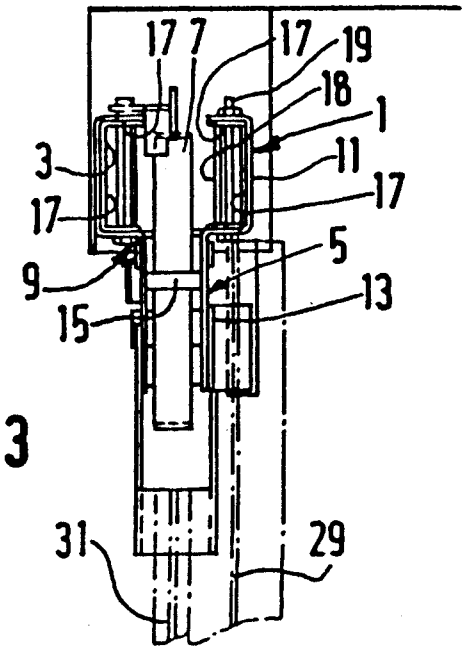
FIG. 3 is a sectional view through line A—A of FIG. 2.
Figure 2:
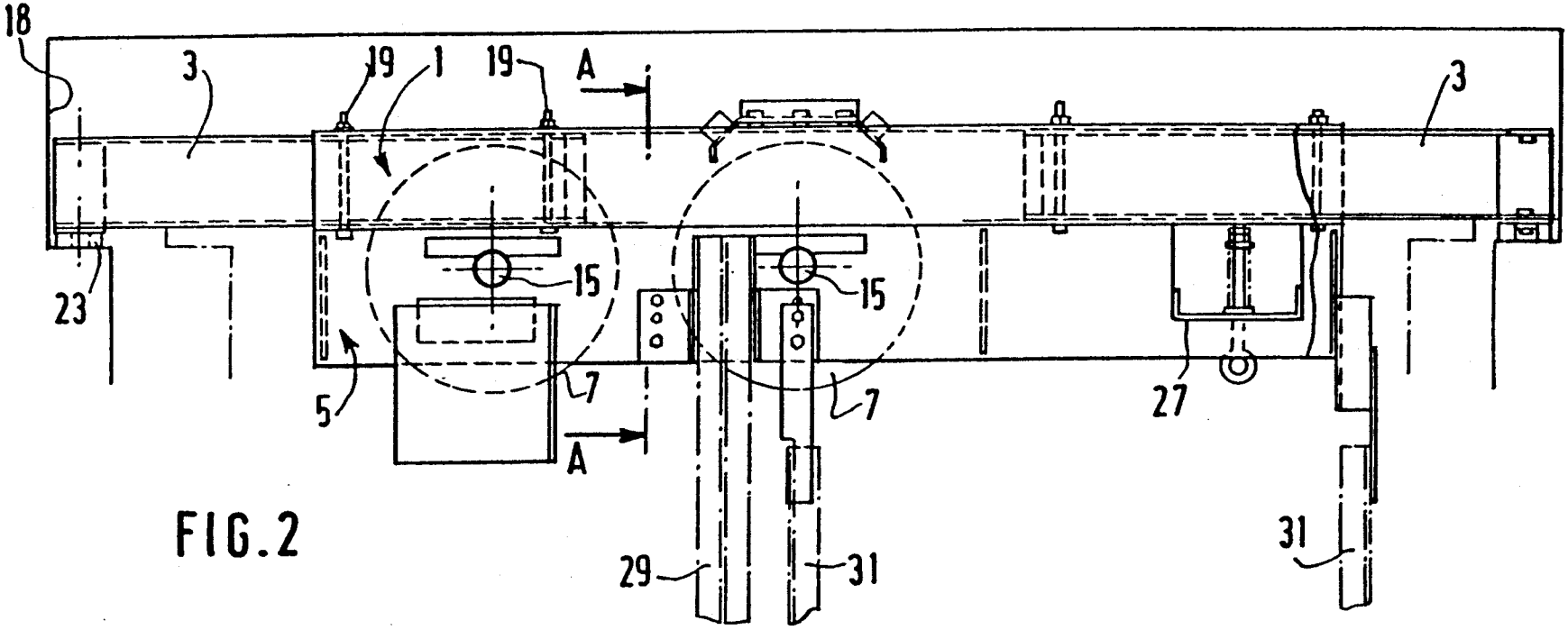
FIG. 2 is a longitudinal elevational view similar to FIG. 1 of the beam mounted in the elevator shaft with the arms extended.
Figure 4:
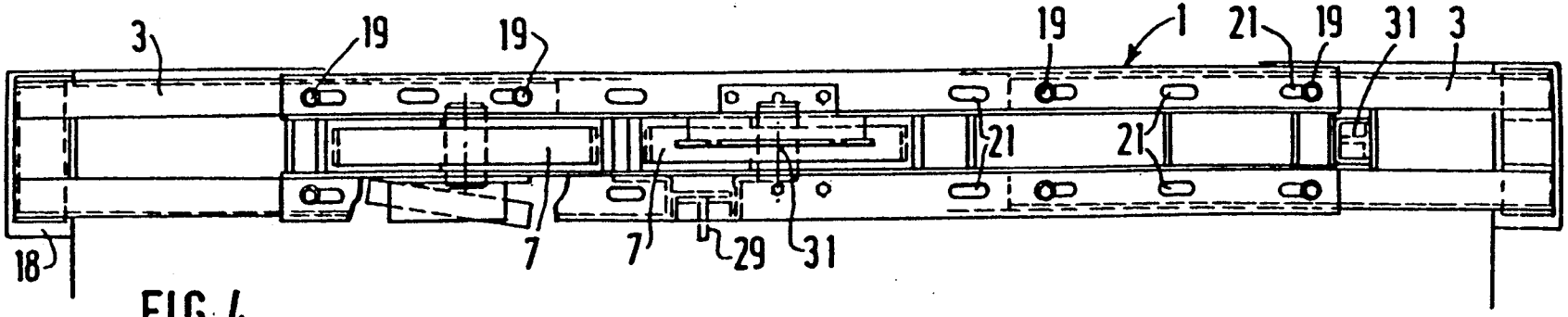
FIG. 4 is a top view with parts cut away of the beam.

As shown in these figures, the elevator beam of the invention is formed essentially of an upper tubular body 1 housing at each of its ends a telescopic arm 3 and including lower skirt 5 fastened to body 1 and carrying the sheaves 7 for the ropes of the elevator. The width of skirt 5 is equal to that of sheaves 7 plus an operating clearance. Body 1 is open longitudinally at its upper part by this same skirt width. Each of the lateral parts 9 forming the body and the skirt is formed from the same suitably profiled shape, the two profiled shapes being opposite each other with symmetry with respect to the median longitudinal plane. The upper part 11 of each profiled shape 9 is in the form of an inwardly turned U and the lower part 13 is flat. The flat portions 13 are braced and receive the sheave shafts 15 suitably keyed at their ends. The telescopic arms 3 are each formed of two opposite U-shaped bars 17 reinforced by gussets 38. These bars have a profile complementary, except for the clearance, to that of the U-shaped flanges 11 of the beam body so that each is housed thereinside and may slide freely. They are spaced apart substantially by the width of skirt 5 so as to slidingly pass around the rims of sheaves 7. Arms 3 may slide from a retracted position (FIG. 1) in which their internal opposite ends extend inwardly to substantially the center of the beam, to an extended position, such as shown in FIG. 2, in which their external ends are each fitted into the support defined by shaft recesses 18. The arms are each locked in position with the body 1 of the beam by four thru-bolts 19 disposed vertically in pairs as shown in FIG. 4. Longitudinal apertures 21 are provided for allowing free movement for adjusting the position of the arms within the support defined by the recesses. The lower end of each arm is provided with a support plate which engages a rubber shoe 23 isolating the beam from the building.

The foregoing clearly shows the convenience in positioning such a beam. In the retracted position of the arms, its length is substantially less than the width of the elevator shaft so that it may be readily winched into position at the top of the elevator shaft. In this position, the arms may be extended into the shaft recesses and locked in position and the beam is thus supported with the arms resting on the isolating shoes. Labels 25 on the travel path of the arms indicate the permissible stress level at varying distances of arm extension.

It will be noted that other equipment may be mounted on the beam other than that described, such as a counterweight fixed point plate 27, to which end eyelet rods of the cables are secured and tools for fixing the guides in their final position, e.g. a string of cabin guides 29 and two strings of counterweight guides 31.

We claim:

1. A support beam for elevator sheaves to be mounted in a hoistway of a predetermined width having recesses defined by the hoistway walls which comprises: a load carrying beam having at least one telescopic arm (3) mounted at an end of the beam, said arm having a first retracted position when the length of the beam is less than the predetermined hoistway width for facilitating positioning of the beam in the shaft and a second extended position in which the arm is extended to engage a corresponding hoistway recess (18) provided for receiving the arm and the length of the beam is greater than the predetermined hoistway width.

2. A support beam according to claim 1, and further comprising said support beam having a telescopic arm mounted at each end thereof, said beam having an open body portion and said telescopic arms (3) being mounted to slide within the body portion of the beam.

3. A support beam according to claim 2 and further comprising labels (25) positioned on the beam along the travel path of the arms (3), said labels being marked to indicate the permissible stress limits at various positions of the arms.

4. A support beam according to claim 2 which further comprises sheaves 7, a counterweight fixed point plate (27) and tools for fixing guides all mounted to the body portion of the beam.

5. A support beam according to claim 1 which further comprises: an upper tubular body (1) having the telescopic arm (3) slidably mounted therein, a lower skirt (5) secured to the tubular body and sheaves (7) for receipt of elevator ropes mounted to the lower skirt.

6. A support beam according to claim 5 which further comprises: the tubular body and skirt being formed of two opposite profiled shapes (9) symmetrical with respect to the median longitudinal plane, each being in the form of an inwardly turned U forming the body portion and a vertically braced flat shape forming the skirt portion, the telescopic arm (3) having a section complementary, except for a clearance space, to that of the body part for sliding freely therein.

7. A support beam according to claim 6 which further comprises: thru-bolts (19) positioned in longitudinal apertures (21) for permitting position adjustment and locking of arm (3) relative to the body portion.

8. A method of installing a support beam in an elevator shaft having defined recesses in the shaft wall which comprises the steps of a) raising the support beam into position adjacent the recesses defined by the shaft wall;
b) extending a telescopic arm from one end of the support beam into one recess;
c) extending a telescopic arm from the other end of the support beam into another recess; and
d) lowering the support beam into position with the telescopic arms engaging the shaft walls defining the recesses thereby supporting the beam in the desired position.

* * * * *